United States Patent [19]

Adamson, Jr.

[11] 4,114,855

[45] Sep. 19, 1978

[54] COLLECTOR FOR HOIST CHAIN

[75] Inventor: James R. Adamson, Jr., Alexandria, Va.

[73] Assignee: The United States of America as represented by the Secretary of the Army, Washington, D.C.

[21] Appl. No.: 810,821

[22] Filed: Jun. 28, 1977

[51] Int. Cl.[2] ..... B66D 1/76

[52] U.S. Cl. ..... 254/175.5; 74/68

[58] Field of Search ..... 254/175.5, 137, 167, 254/168, 144, 190 R, 170, 171, 169; 226/77, 87; 214/1 P, 1 QC; 187/94; 212/135; 74/63, 68

[56] References Cited

U.S. PATENT DOCUMENTS

| | | | |
|---|---|---|---|
| 68,794 | 9/1867 | Rung | 254/170 |
| 235,645 | 12/1880 | Pyott | 254/170 |
| 1,164,629 | 12/1915 | Bergman | 254/137 |
| 1,239,110 | 9/1917 | Knutson | 254/175.5 |
| 1,327,181 | 1/1920 | Taussig | 254/167 |
| 2,286,388 | 6/1942 | Smith | 254/175.5 |
| 2,453,581 | 11/1948 | Moore | 254/167 |
| 2,979,829 | 4/1961 | Uhleen | 254/175.5 |

FOREIGN PATENT DOCUMENTS

| | | | |
|---|---|---|---|
| 45,195 | 8/1924 | Fed. Rep. of Germany | 254/175.5 |

*Primary Examiner*—Trygve M. Blix
*Assistant Examiner*—Kenneth W. Noland
*Attorney, Agent, or Firm*—Nathan Edelberg; Milton W. Lee; Aubrey J. Dunn

[57] ABSTRACT

A differential gear or motor driven shaft carries drive sprockets for a main chain having a load end and a tail end. The shaft also carries a pulley or gear for driving with a belt or chain a corresponding pulley or gear on an intermediate shaft. This intermediate shaft also carries a pulley or gear which drives a belt or chain, and this belt or chain in turn turns a pulley on an idler shaft. The idler shaft also has chain idler pulleys thereon and other pulleys or gears for driving with belts or chains corresponding pulleys or gears on chain storage shafts. These chain storage shaft carry chain storage sprockets. The main chain is reeved around the drive sprockets, with the load ends hanging down and the tail ends reeved around the idler pulleys and the chain storage sprockets. As the load ends of the main chain are hauled in or paid out, the tail ends are respectively fed into or out of chain storage bins beneath the chain storage sprockets.

3 Claims, 3 Drawing Figures

COLLECTOR FOR HOIST CHAIN

The invention described herein may be manufactured, used, and licensed by the U.S. Government for governmental purposes without the payment of any royalties thereon.

BACKGROUND OF THE INVENTION

Differential chain hoists and motor driven chain hoists are well known as mechanical lifting or pulling devices. However, when used as overhead lifters such hoists have the problem of dangling tail ends. These dangling ends can be safety hazards or can damage delicate loads being hoisted. Some ways have been devised for storing such chain tail ends, such as those shown in U.S. Pat. Nos. 2,286,388, 2,859,937 and 2,998,226. All these patents show the chain stored below the chain driving sprockets. U.S. Pat. No. 3,917,229 shows a further chain storage device, but with (a) motor(s) separate from the chain drive motor being used to store the chain. The instant invention overcomes the disadvantages of these patented devices by storing its chain above the chain drive sprockets, and by not requiring a separate drive motor for the tail end of the chain.

SUMMARY OF THE INVENTION

The invention is a collector for the tail end of a chain driven by load sprockets on the load shaft of a chain hoist. This collector has a shaft carrying chain storage sprockets and is driven from the chain load shaft. A chain bin above the load sprockets stores the tail end of the chain.

DETAILED DESCRIPTION OF THE INVENTION

Figure 1:
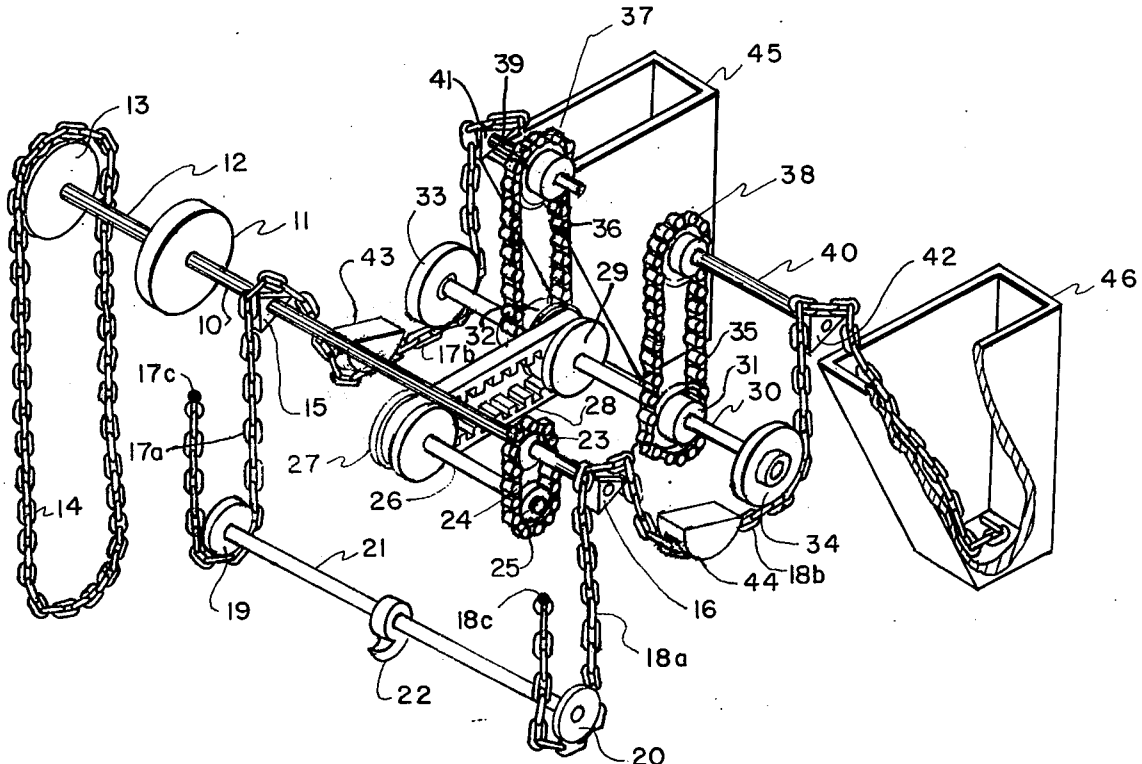
FIG. 1 shows a schematic-isometric view of the invention.

The invention may perhaps be best understood by referring to the drawings, in which FIG. 1 shows a chain hoist having main shaft 10 driven reduction gears 11 coupled by shaft 12 to chain pulley 13. Chain pulley 13 is manually operated by chain 14. Alternatively, main shaft 10 could be driven by an electric or a hydraulic motor, not shown. Shaft 10 carries chain drive cogs 15 and 16, around which two main chains are reeved. The chain around cog 15 includes load end **17*a* and tail end 17*b*; around cog 16 is a chain with load end 18*a* and tail end 18*b*. Load ends 17*a* and 18*a* hang down and are reeved around hook pulleys 19 and 20**.

Between pulleys 19 and 20 is hook shaft 21 supporting hook 22. Bitter ends **17*c* and 18*c* of 17*a* and 18*a* are affixed to and supported by the frame (not shown) of the chain hoist. This frame also supports main shaft 10 and the various other elements yet to be described. Normally, tail ends 17*b* and 18*b* hang down parallel to ends 17*a* and 18*a* and may interfere with a load carried by hook 22. Thus far, all of the elements described are those usual and normal to a chain hoist. The invention includes various elements in combination with each other and the already described elements whereby tail ends 17*b* and 18*b* are stored well above any load carried by hook 22. These various elements include roller chain cog 23 affixed to main shaft 10. Roller chain 24 is reeved around 23 and around roller chain cog 25. Cog 25 is affixed to intermediate shaft 26, and cog belt pulley 27 is also affixed thereto. Cog belt 28 is reeved around pulley 27 and around pulley 29 affixed to idler shaft 30. Also affixed to shaft 30 are roller chain cogs 31 and 32. Idler pulleys 33 and 34 are also carried by shaft 30 but are not affixed thereto. Roller chains 35 and 36 are respectively reeved around cogs 31 and 32 and also respectively around cogs 37 and 38 respectively affixed to chain storage shafts 39 and 40. Chain storage cogs 41 and 42 are respectively affixed to shafts 39 and 40**.

Tail ends **17*b* and 18*b* of the main chains are passed around respective chain guides 43 and 44, around respective idler pulleys 33 and 34, around respective storage cogs 41 and 42, and into respective storage bins 45 and 46. As main shaft 10 rotates, it drives roller chain 24 by cog 23. Chain 24 turns cog 25, and shaft 26 to which 25 is affixed turns pulley 27. Cogged belt 28 is thus driven by pulley 27 to turn pulley 29, and thereby turn shaft 30. As shaft 30 turns, cogs 31 and 32 rotate therewith and drive roller chains 35 and 36. Thus, chain storage cogs 41 and 42 are turned respectively by shafts 39 and 40 to which are affixed roller chain cogs 37 and 38 driven by roller chains 36 and 35**. It should be understood that each of the various shafts, the chain guides, and the chain storage buckets are supported by the frame (not shown) of the chain hoist. This arrangement as described thus allows the tail ends of the main chains to be stored or paid out from storage as the load ends are respectively paid out or hauled in.

Figure 2:
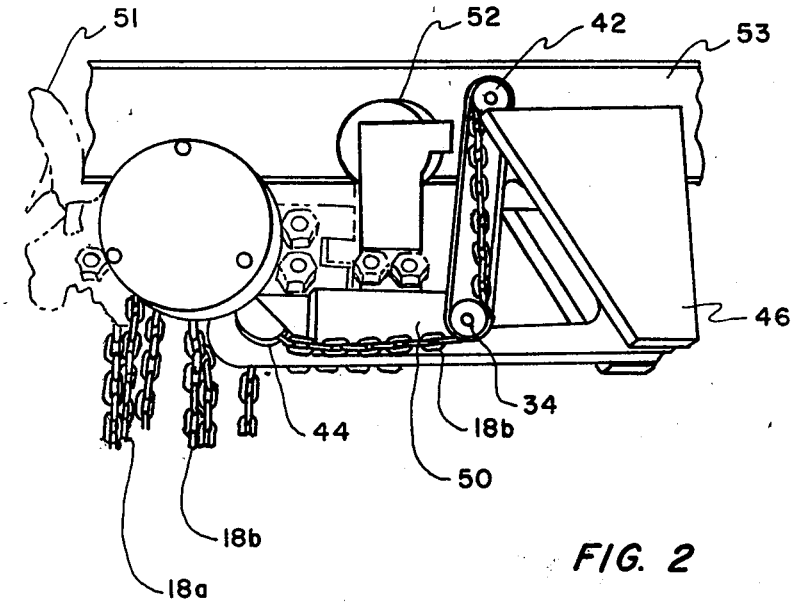
FIG. 2 shows an isometric side view of the invention.

FIG. 2 shows some of the elements of FIG. 1 in a more realistic view. Moreover, some of the hoist frame as mentioned but not shown for FIG. 1 can be seen at 50. This frame is carried by rollers 51 and 52 on rail 53.

Figure 3:
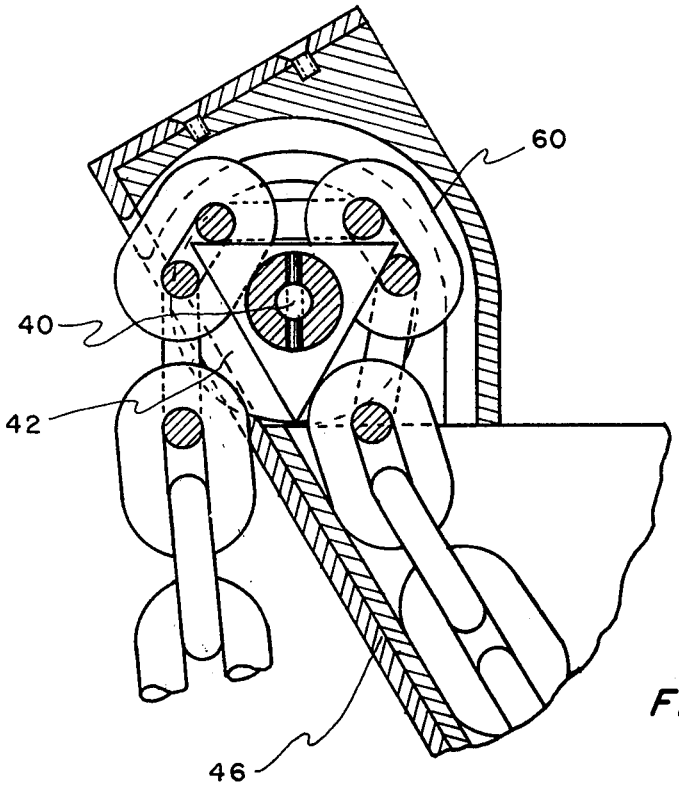
FIG. 3 shows a detail view of a portion of FIG. 2.

FIG. 3 shows a detail of the invention not previously mentioned. The tail ends of the main chains passing over the chain storage cogs (41 and 42) occasionally tend to ride off the storage cogs, as when chain is being stored and begins to fill the chain storage buckets. This tendency is countered by guide fingers 60 (for cog 42) that fit over cog 42 and slightly clear the chain. These fingers are affixed to bucket 46 and prevent the chain from riding off cog 42. This drawing figure also shows the detail of cog 42. As can be seen, this cog has an equilateral triangular portion engaging the links of the main chain, with flanges on either side of the triangular portion. Obviously, there are guide fingers, similar to fingers 60, associated with cog 41.

Although I have specifically recited various roller chains and cogged belts with their respective sprockets in my invention, obviously other types of positive torque conveyers may be used, such as bead chains, etc. Obviously, the overall ratios between the various cogs and chains, etc. is such that cogs 41 and 42 turn at the correct speed to match any paying out or hauling in of main chain by cogs 15 and 16. This is easily accomplished by having the diameters of respective driving and driven pulleys or cogs for a particular torque conveyer in a 1 to 1 ratio.

I claim:

1. In a chain hoist including a shaft connected to drive a chain sprocket; a chain reeved around said sprocket, and having a load end and a tail end, whereby said load end of said chain may be hauled in and paid out by said sprocket, the improvement comprising:

a chain collector for said tail end of said chain, said collector including: a drive pulley affixed to said shaft; a driven shaft having at least a chain storage sprocket around which said tail end of said chain is reeved and a driven pulley affixed to said driven shaft; drive means between said pulleys; and a chain storage bin adjacent said chain storage sprocket whereby said tail end of said chain is deposited in said bin by said chain storage sprocket as said load end of said chain is hauled in, and whereby said tail end of said chain is fed from said bin as said load end of said chain is paid out, wherein said drive means includes:

an intermediate shaft having two intermediate pulleys affixed thereto and a first torque conveyer between one of said intermediate pulleys and said drive pulley; an idler shaft having at least two idler pulleys affixed thereto; a second torque conveyer between the other one of said intermediate pulleys and a first one of said idler pulleys; and a third torque conveyer between said driven pulley and the other of said idler pulleys.

2. The chain hoist as defined in claim 1 further including an idler sprocket journaled on said idler shaft and with said chain reeved therearound.

3. The chain hoist as defined in claim 2 wherein said chain storage sprocket includes an equilateral triangular drive portion concentric to said driven shaft, with flanges on either side of said portion.

* * * * *